US011092045B1

(12) United States Patent
Parker et al.

(10) Patent No.: US 11,092,045 B1
(45) Date of Patent: Aug. 17, 2021

(54) CONTROL VALVE FOR CAM PHASER AND METHOD FOR MOUNTING THE CONTROL VALVE

(71) Applicant: ECO Holding 1 GmbH, Marktheidenfeld (DE)

(72) Inventors: Kenneth Parker, Muskegon, MI (US); Dave Fiddes, Lake Orion, MI (US); Mustafa Mohammed, Rochester Hills, MI (US); Kevin Phillips, Clarkston, MI (US); Daniel Stanhope, Nunica, MI (US)

(73) Assignee: ECO Holding 1 GmbH, Marktheidenfeld (DE)

( * ) Notice: Subject to any disclaimer, the term of this patent is extended or adjusted under 35 U.S.C. 154(b) by 0 days.

(21) Appl. No.: 16/826,240

(22) Filed: Mar. 22, 2020

(51) Int. Cl.
*F01L 1/344* (2006.01)

(52) U.S. Cl.
CPC ..... *F01L 1/3442* (2013.01); *F01L 2001/3443* (2013.01); *F01L 2001/34426* (2013.01); *F01L 2001/34433* (2013.01)

(58) Field of Classification Search
CPC ... F01L 2001/34426; F01L 2001/34433; F01L 1/344; F01L 2001/3443; F16K 11/10
USPC ..... 123/90.17, 90.15
See application file for complete search history.

(56) References Cited

U.S. PATENT DOCUMENTS 6,899,126 B2 * 5/2005 Weigand ..... F01L 1/34 137/512.15
9,322,419 B2 * 4/2016 Hutzelmann ..... F15B 15/20
2014/0311333 A1 * 10/2014 Hutzelmann ..... F01L 1/3442 91/418
2016/0130989 A1 * 5/2016 Fischer ..... F01L 1/3442 123/90.15
2017/0058727 A1 * 3/2017 Smith ..... F01L 1/047
2017/0145913 A1 * 5/2017 Diehm ..... F16K 15/063
2017/0241302 A1 * 8/2017 Haltiner, Jr. ..... F01L 1/3442
2017/0260884 A1 * 9/2017 Nance ..... F01L 1/3442
2018/0135471 A1 * 5/2018 Kajita ..... F01L 1/047
2018/0363514 A1 * 12/2018 Stanhope ..... F01L 1/3442

FOREIGN PATENT DOCUMENTS

DE 102013104575 A1 11/2014
DE 102014103400 B3 * 6/2015 ..... F16K 31/0613

* cited by examiner

*Primary Examiner* — Patrick Hamo
*Assistant Examiner* — Wesley G Harris
(74) *Attorney, Agent, or Firm* — Von Rohrscheidt Patents

(57) ABSTRACT

A control valve for a cam phaser of an internal combustion engine, the control valve including a cylindrical housing, including a first operating connection, a second operating connection, a supply connection, and a tank drain connection configured to drain a hydraulic fluid; a control piston device, including a control piston, a supply tube, a first check valve and a second check valve enabling cam torque recirculation, wherein the control piston device is arranged in the housing and axially movable by an actuator, wherein the first check valve is configured with a first disc portion and a second disc portion and the second check valve is configured with a third disc portion and a fourth disc portion and the first check valves and the second check valve are arranged offset from each other by a compression coil spring.

9 Claims, 7 Drawing Sheets

CONTROL VALVE FOR CAM PHASER AND METHOD FOR MOUNTING THE CONTROL VALVE

FIELD OF THE INVENTION

The invention relates to a control valve for a cam phaser.

BACKGROUND OF THE INVENTION

Cam phasers are used in valve trains of internal combustion engines in order to be able to variably adjust a phase relationship between the crankshaft and the camshaft in an optimum manner. Thus, control valves or hydraulic valves are being used to control a fluid flow between a pressurized fluid supply and the cam phaser and a reservoir or tank. Control valves of this type have plural control positions that facilitate adjusting a path of a fluid flow. Thus, an adjustment of the cam phaser and thus of the camshaft into a predetermined phase orientation is performed as a function of a control position.

Generic art is well known. DE 10 2013 104 575 A1 illustrates a hydraulic valve for a cam phaser which includes a sleeve element with a longitudinal channel, a first transversal channel that branches off from the longitudinal channel and a second transversal channel that branches off from the longitudinal channel and a pressure balanced hollow piston that is arranged axially moveable within the longitudinal channel between a first end position and a second end position. Thus, the longitudinal channel has a first channel section with a greater inner diameter and a second channel section with a smaller inner diameter, wherein the first transversal channel originates from the first channel section and the second transversal channel originates from the second channel section. Thus, the hollow piston includes a longitudinal channel with an axial opening, at least one transversal channel, a first piston section with a greater external diameter, and a second piston section with a smaller external diameter, wherein the hollow piston is supported with sealing tolerance at its first piston section at the first channel section of the longitudinal channel and with its second piston section with a sealing tolerance at the second channel section of the longitudinal channel.

BRIEF SUMMARY OF THE INVENTION

It is an object of the invention to improve the control valve recited supra and to simplify its assembly.

According to one aspect of the invention, the object is achieved by a control valve for a cam phaser of an internal combustion engine. The control valve includes a cylindrical housing with a first operating connection, a second operating connection, a supply connection and a tank drain connection configured to drain the hydraulic fluid. The control valve furthermore includes a control piston device with a control piston, a supply tube, a first check valve and a second check valve enabling cam torque recirculation, wherein the control piston device is arranged in the housing axially movable by an actuator. Thus, the first check valve is configured with a first disc portion and a second disc portion and the second check valve is configured with a first disc portion and a second disc portion. The check valves are arranged offset from each other by a compression coil spring, so that a control chamber is formed between the first disc portions. The second disc portions are axially movable on the supply tube. Thus, the supply tube is configured with stop elements to limit an axially movement of the check valves in the direction of the control chamber.

Advantageous embodiments are provided in the independent claims.

The improved control valve has the advantage of combining a simple and cost-effective configuration with a particularly quick cam shaft adjustment. This is achieved in particular in that the supply tube is configured with the stop elements to limit the axially movement of the check valves. Thus the control valve according to the invention is configured very short or compact in the axial direction which saves space in the joint arrangement with the cam phaser and provides space for new functional components as required. It can advantageously be ensured that the supply connection remains open during cam torque recirculation function (CTR).

According to an advantageous embodiment the check valves are made from light metal, advantageously made from aluminum. The check valves can also be made from other light materials, e.g. from a synthetic material. Using the light material like e.g. the aluminum light metal minimizes a moving weight of the check valves and thus accelerates a response or a reaction of the check valves. Additionally aluminum being a very durable and resilient material provides a very long service life for the check valves.

Furthermore the stop elements are advantageously configured as larger diameter portions of the supply tube. Thus, the CTR function with a best reaction is ensured easily and cost-effective.

Advantageously the first disc portions are applied in a sealing manner with their outer edges to a reduced diameter of control piston a check valve flow cup, wherein the check valve flow cup is arranged in the control piston. A sealing contact of the first disc portions facilitates an efficient use of the check valves. Thus, the entire fluid flow is directed in predetermined paths and/or directions and an unintentional deviation of a partial flow is prevented.

Advantageously the supply tube includes at least one inlet opening to the control chamber wherein the inlet opening is arranged so that the fluid of the control chamber is fed centrally and symmetrically between the check valves. A central and symmetrical feeding into the control chamber or into the space between the check valves provides a uniform and turbulence free inflow and/or flow through of the fluid irrespective of a particular control position of the control valve. Resulting advantages are a quicker response and a constant and reliable operation of the control valve over all possible positions.

Thus, the supply tube is advantageously configured with a hollow cylinder which includes the inlet opening to the control chamber and a connection opening for connecting with the supply connection. Thus, the connection opening for the supply connection is advantageously arranged at a narrower end of the piston shaft. From the supply connection the fluid is conducted through the connection opening into the hollow cylinder so that fluid can flow into the control chamber. Thus a very simple and therefore barrier free and thus very quick feeding of the fluid to the control valve can be provided.

In a particularly advantageous embodiment the supply tube is configured so that the second disc portions are arranged so that they are movable onto the supply tube in axial direction, wherein the compression coil spring is arranged between the first disc portions and ends of the spring are guided by axial disc projections. This optimized design prevents the check valves and the spring from tipping or wedging and prevents the check valves from wearing out.

Thus, both check valves operate with the same spring. This arrangement provides a particularly compact and simple configuration of the control piston device. The number of components is minimized, in this case by the jointly used spring. Furthermore complexity and number of components is minimized, thus by the identical configuration of the first and the second piston disc. Material and fabrication costs are significantly reduced.

The spring is advantageously configured as a compression coil spring in this embodiment like in all preceding and subsequent embodiments. The compression coil spring is loaded by compressing the ends, wherein a force introduction is provided by the end windings. The stored energy is released again when the spring is unloaded which pushes the check valve to seal against the piston or flow cup.

According to an advantageous embodiment the control piston arrangement is movable into a first position and second position and a third position as well as various positions between the first position and third position.

Thus the check valves are arranged in the control piston so that the first operating connection is closed by the first disc portion of the first check valve for a fluid flow from the control chamber in the first position wherein an inflow of fluid from the first operating connection into the control chamber and to the second operating connection is possible by the check function of the first check valve. Furthermore the two check valves are arranged in the control piston so that both operating connections are closed in the second position. In a third position the second operating connection is closed by the first disc portion of the second check valve for a fluid flow from the control chamber wherein a flow of fluid from the second operating connection into the control chamber and to the first operating connection is possible through a check function of the second check valve.

Using the three positions, also designated as control positions a function and purpose of the check valve, namely adjusting a fluid flow are implementable. As already recited supra an adjustment of the cam phaser and thus of the cam shaft into a particular phase orientation is possible as a function of a control position of the control piston.

According to another advantageous embodiment the first check valve and the second check valve are axially arranged in the control piston and have opposite opening directions. Thus, the check valves are advantageously configured with identical piston discs that are arranged as mirror images of each other on the control pistons.

BRIEF DESCRIPTION OF THE DRAWINGS

Additional advantages of the invention can be derived from the description and the drawing figures. The invention is subsequently described in more detail based on embodiments with reference to drawing figures, wherein.

DETAILED DESCRIPTION OF THE INVENTION

A control valve that is illustrated in FIGS. 1-12 is used to adjust a path of a fluid flow and resulting therefrom a phase orientation of a cam phaser or of its rotor.

Figure 1:
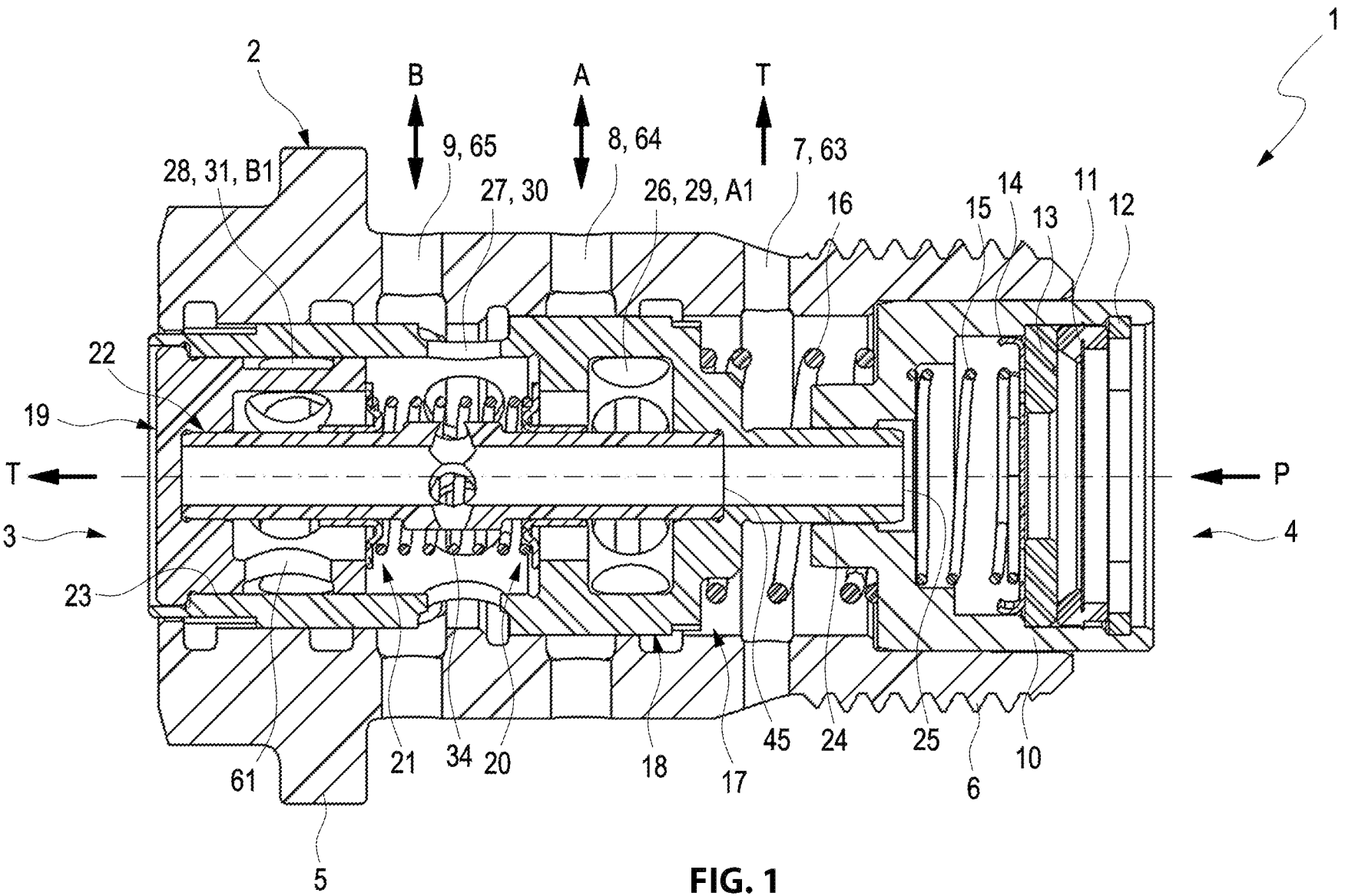
FIG. 1 illustrates a longitudinal sectional view of a first embodiment of a control valve according to the invention.

FIG. 1 illustrates a first embodiment of a control valve 1 with a cylindrical housing 2 that is configured herein as a central bolt. The housing 2 includes a head side 3 and an insertion side 4, wherein a hexagonal head 5 is arranged at the head side 3 and an external thread 6 is arranged at the insertion side 4. Furthermore the housing 2 includes numerous openings that are provided as first operating connections A, second operating connections B, supply connection P and tank drain connections T. Thus, the opening at the insertion side 4 is a supply connection P. The openings that are arranged at or in the housing 2 in a radially circumferential manner in a respective hole series 7, 8, 9. Starting from the insertion side 4 the openings in the first hole row 7 are tank drain connections T with openings 63, in the second hole row 8 the openings 64 are first operating connections A and in the third hole row 9 the openings 65 are second operating connections B. A calibration cap 10 protrudes from the opening at the insertion side 4 wherein a supply filter 11 is arranged in the calibration cap 10 and retained in the calibration cap 10 by a safety ring 12.

The control valve 1 controls a cam phaser and attaches it at the cam shaft. The attachment is performed by threading the housing 2 that is configured as a central bolt and by the hexagonal head 5 arranged at the housing 2 and by the external thread 6. The controlling is performed by the connections A, B, P and T. Thus, a fluid is introduced into the control valve 1 by the supply connection P. The operating connections A and B and fluid, flowing out either through the operating connections A or the operating connections B, facilitates respectively controlling one respective operating connection of the two operating connections or phase arrangements of the cam phaser. The tank drain connection T is only used for draining superfluous fluid.

The control valve 1 also includes a flow disc 13, a supply connection non-return valve 14, a non-return valve spring 15, a calibration spring 16 and last not least a control piston device 17 according to the invention.

Figure 5:
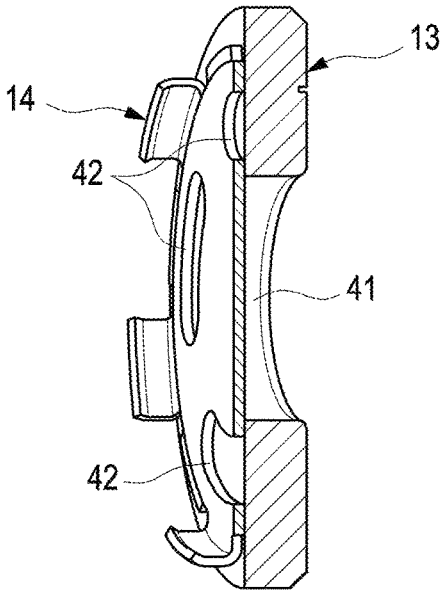
FIG. 5 illustrates an perspective view of the non-return valve and the flow disc of the control valve according to FIG. 1.
Figure 6:
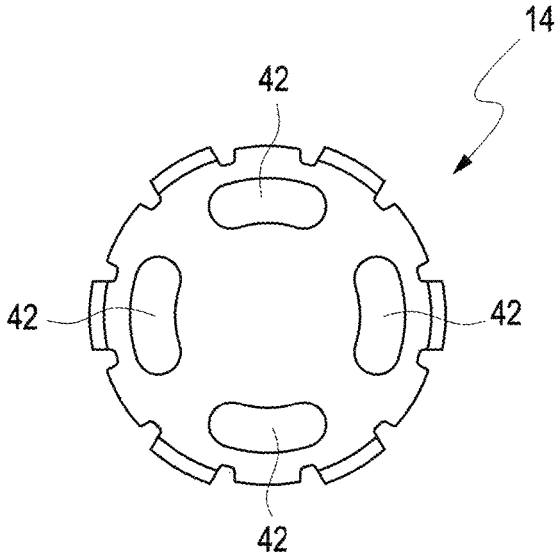
FIG. 6 illustrates the non-return valve according to FIG. 5.
Figure 7:
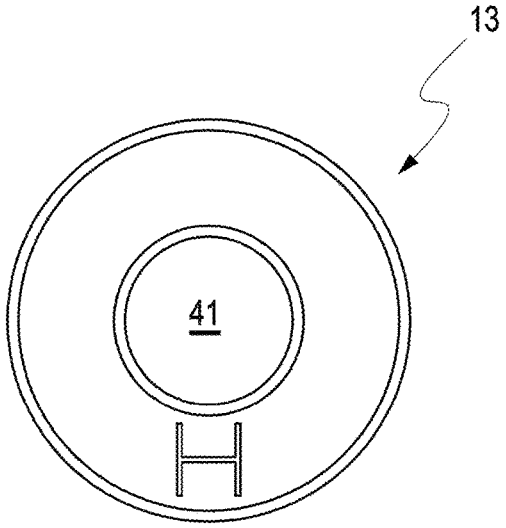
FIG. 7 illustrates the flow disc according to FIG. 5.

The supply connection non-return valve 14 is held against the flow disc 13 by the non-return valve spring 15. The non-return valve 14 opens when the force of the supply pressure acting on the disc 13 is greater than the spring force and the force of the pressure acting on the non-return valve 14. FIGS. 5-7 illustrate that the flow disc 13 includes a circular opening 41 along a center axis of the flow disc 13, whereas non-return valve 14 includes openings 42 in an outer section, so that opening 41 of the flow disc 13 and the openings 42 of the non-return valve 14 do not overlap in a closed state. This configuration allows an improved response of the non-return valve 14 and improved flow from P due to one larger opening 41 along the center axis. Pressure loss can be reduced further.

The control piston device 17 includes a control piston 18, a first check valve 20, a second check valve 21, a supply tube 22 and a check valve flow cup 19.

The control piston 18 includes a mounting opening 23 on the head side 3 and a supply spout portion 24 with a supply opening 25 on the insertion side 4. Additionally the control piston 18 like the housing 2 in FIG. 1 also has three hole rows with openings, wherein the hole rows are configured as a fourth hole row 26, a fifth hole row 27 and a sixth hole row 28. Starting from the insertion side 4 the openings in the first hole row 26 are first operating pass through openings 29 (also called A1), in the fifth hole row 27 central pass through openings 30 and in the sixth hole row 28 second operating pass through openings 31 (also called B1).

Figure 2:
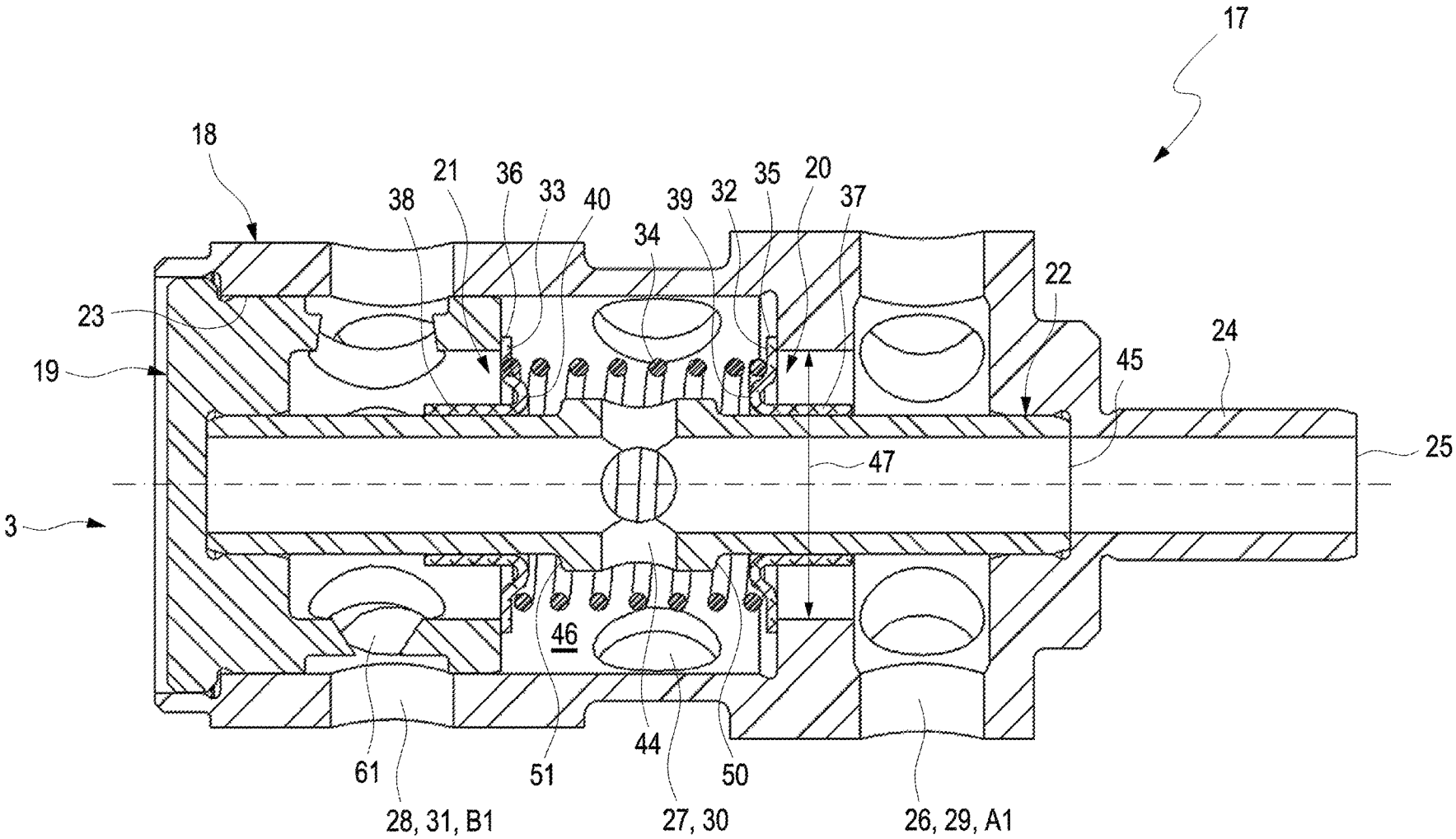
FIG. 2 illustrates an enlarged section of the longitudinal sectional view of the control piston device of the control valve according to FIG. 1.

The check valves 20, 21, which enable cam torque recirculation and which are best shown in FIG. 2 showing an enlarged control piston device 17 of the control valve 1 of FIG. 1, are configured with a first disc portion 32, 33, a second disc portion 37, 38 and a spring 34 that is thus configured as a compression coil spring. Thus, the first disc portion 32 and the second disc portion 37 forms the first check valve 20 and the first disc portion 33 and the second disc portion 38 forms the second check valve 21. Thus, a respective outer edge 35, 36 of the first disc portion 32, 33 is arranged at the first discs portions 32, 33, which can be configured in the non-illustrated embodiment with additional radial seals or seal elements at the outer edges 35, 36. As can be seen from FIG. 2 the outer edges 35, 36 are biased against a reduced diameter 47 of the control piston 18 and the check valve flow cup 19, which is fixedly arranged in the control piston 18 at the head side 3.

Inlet openings 44 are arranged at the hollow supply tube 22 in a radially circumferential manner. Additionally the supply tube 22 terminates on the insertion side 4 with a connection opening 45.

Additionally a control chamber 46 is visible that is formed during the assembly and arranged within the control piston 18 between the check valves 20, 21 and which is penetrated by the compression coil spring 34. Thus, the control chamber 46 is connected in a fluid conducting manner by the central pass through openings 30 with a portion outside of the control piston 18 and connected by the inlet openings 44 with the supply tube 22 in a fluid conducting manner. Thus the supply tube 22 is applied with its connection opening 45 from an inside or from the head side 3 in a form locking manner to the supply spout portion 24 of the control valve 1.

The second disc portions 37, 38 are axially movable on the supply tube 22, wherein the supply tube 22 is configured with stop elements 50, 51 to limit an axially movement of the check valves 20, 21 in the direction of the control chamber 46. Thus the control valve 1 according to the invention is configured very short or compact in the axial direction which saves space in the joint arrangement with the cam phaser and provides space for new functional components as required. It can advantageously be ensured that the supply connection P remains open during a cam torque recirculation function (CTR).

Furthermore the stop elements 50, 51 are advantageously configured as one or two larger diameter portions of the supply tube 22. Thus, the CTR function with a best reaction is ensured easily and cost-effective.

The compression coil spring 34 is arranged between the first disc portions 32, 33 and ends of the spring 34 are guided by axial disc projections 39, 40, which connect the first disc portions 32, 33 with the second disc portions 37, 38 of the check valves 20, 21. This optimized design prevents the check valves 20, 21 and the spring 34 from tipping or wedging and prevents the check valves 20, 21 from wearing out.

Figure 4:
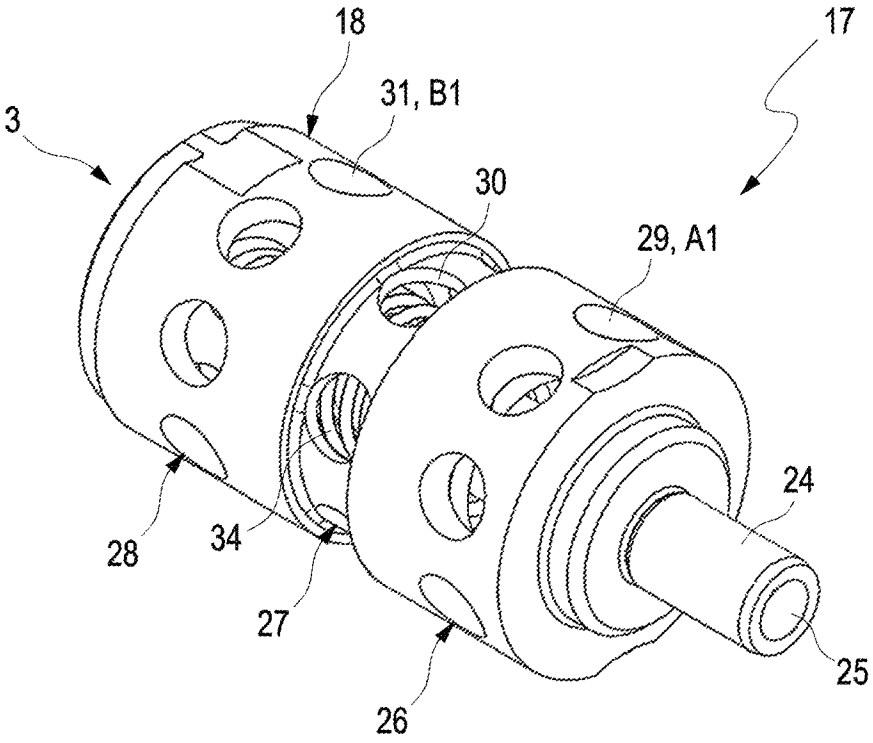
FIG. 4 illustrates an perspective view of the control piston device according to FIG. 2.
Figure 3:
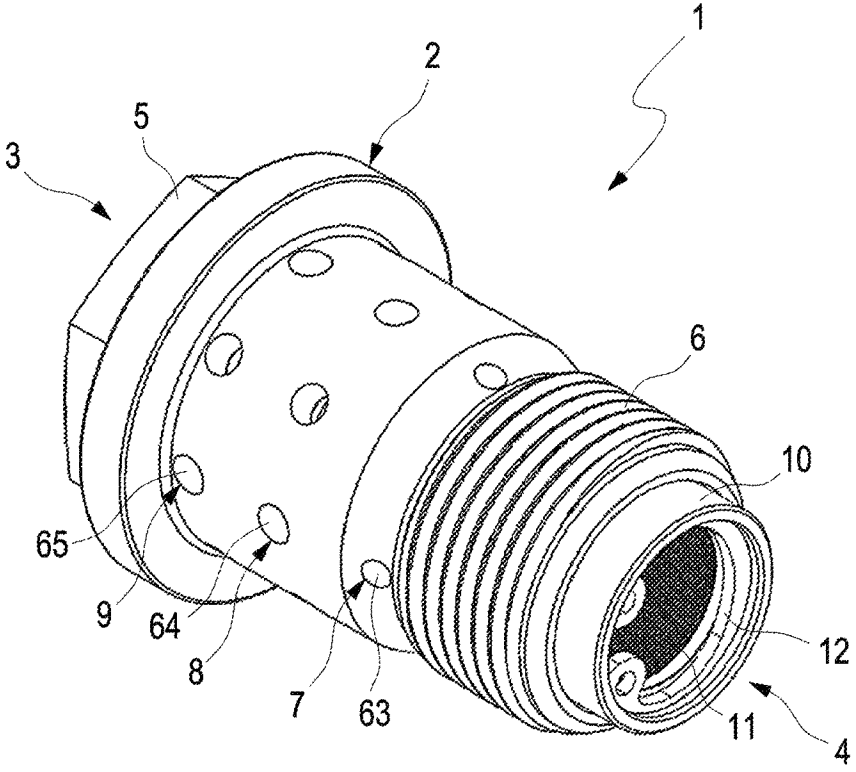
FIG. 3 illustrates an perspective view of the control valve according to FIG. 1.

FIG. 3 and FIG. 4 illustrate perspective views of the control valve 1 and the control piston device 17.

Figure 8:
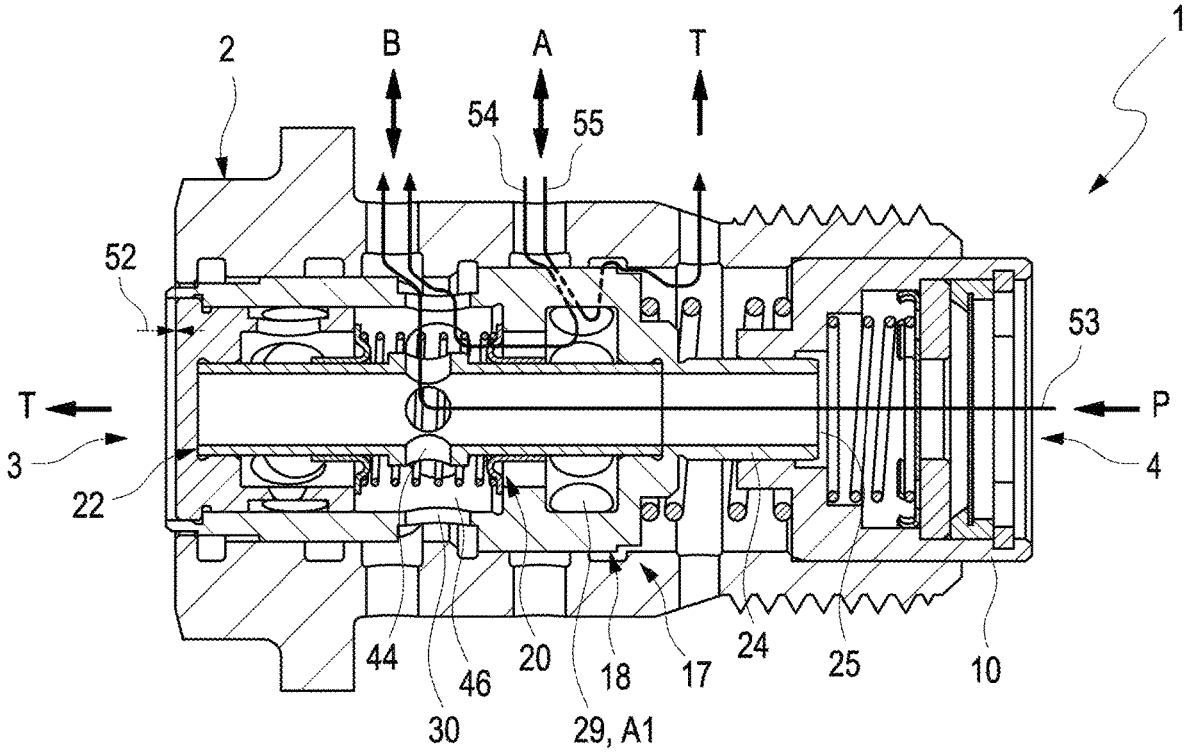
FIG. 8 illustrates a longitudinal sectional view of the control valve according to FIG. 1 with the control piston device in a first position.

FIG. 8 illustrates a longitudinal sectional view of the control valve of FIG. 1 with the control piston device 17 in a first position 52. The position 52 is indicated by two arrows at the head side 3 of the control valve 1 that point towards each other with their arrow tips. Since the position 52 is a starting position no movement has occurred yet or the movement of the control piston device 17 in the housing 2 is 0 mm. The arrow tips are therefore illustrated contacting each other. Due to the position 52 three fluid flows 53, 54, 55 are possible in the control valve wherein the fluid flows are respectively indicated by dashed lines. The dashed lines are respectively configured with an arrow at one end in order to indicate the flow direction of the fluid flows 53, 54, 55. In particular a first fluid flow 53 runs from the supply connection P to the second operating connection B, a second fluid flow 54 runs from the first operating connection A to the second operating connection B, and a third fluid flow 55 runs from the first operating connection A to the radially arranged tank drain connection T. The reference numerals A, B, P and T are illustrated in FIG. 2 for the purpose of clarity only at ends of dashed lines representing the fluid flows 53, 54, 55 and/or at a respective corresponding opening at the housing 2. The mode of illustration used in FIG. 2 also applies for the subsequent FIGS. 3 and 4. Subsequently the exact paths of the fluid flows 53, 55 are described.

The first fluid flow 53 runs from the supply connection P through the calibration cap 10 to the supply spout portion 24 of the control piston 18 and its supply opening 25. From the supply spout portion 24 the first fluid flow 53 runs through the connection opening 45 of the supply tube 22 into its hollow cylinder and subsequently through the inlet opening 44 into the control chamber 46. From the control chamber 46 the first fluid flow 53 runs through the central pass through openings 30 to the second operating connection B.

The second fluid flow 54 runs from the first operating connection A through the first operating pass through openings 29 and the first check valve 20 into the control chamber 46. From the control chamber 46 the second fluid flow 54 runs together with the first fluid flow 53 through the central pass through openings 30 to the second operating connection B.

The third fluid flow 55 that is a simple drain flow runs only from the first operating connection A in the housing 2 and the first operating pass through openings 29 out of the control piston 18 to the radially arranged tank drain connection T.

In the illustrated first position 52 of the control piston device 17 the first operating connection A is closed by the first check valve 20 for a fluid that is fed from the control chamber 46. An exit of the fluid from the first operating connection A to the control chamber 46 and the second operating connection B by a check valve function of the first check valve 20, however is possible.

Figure 9:
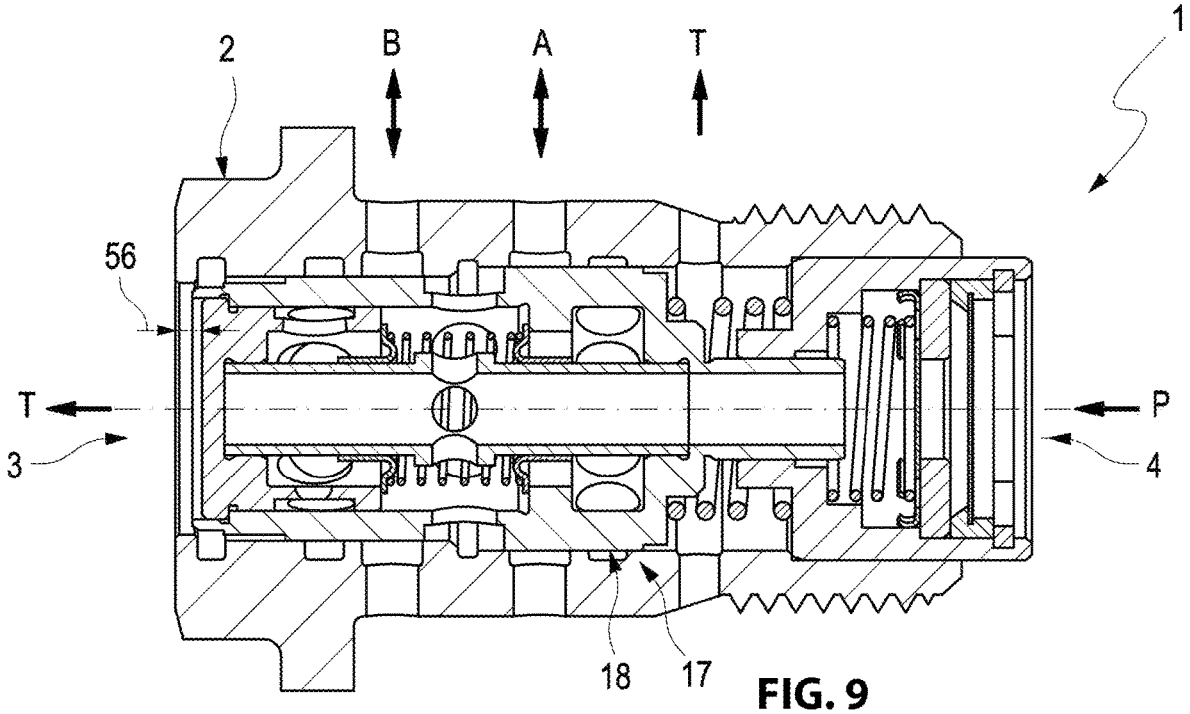
FIG. 9 illustrates a longitudinal sectional view of the control valve according to FIG. 1 with the control piston device in a second position.

FIG. 9 illustrates a longitudinal sectional view of the control valve of FIG. 1 with the control piston device 17 in a second position 56. In the second position 56 the control piston device 17 is arranged inserted a little further, thus in particular by 1.5 mm in a direction towards the insertion side 4 into the housing 2. Thus, there are no fluid conducting connections between the connections A, B, P and T. The two operating connections A, B are closed due to the axial position of the control piston 18. Thus no possible fluid flows are illustrated.

Figure 10:
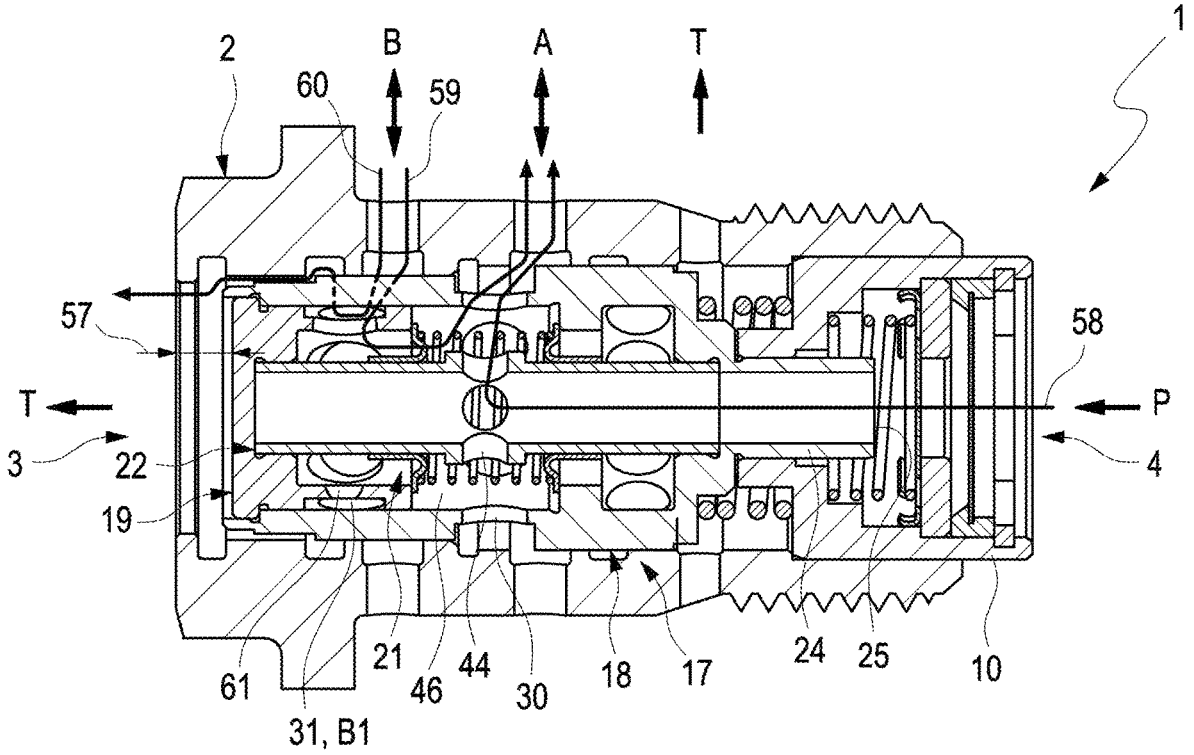
FIG. 10 illustrates a central longitudinal sectional view of the control valve according to FIG. 1 with the control piston device in a third position.

FIG. 10 illustrates a central longitudinal sectional view of the control valve of FIG. 1 with the control piston device 17 in a third position 57. In the third position 57 the control piston device 17 is inserted a little bit further, in particular by an additional 1.5 mm or overall by 3 mm in a direction of the insertion side 4 into the housing 2. Due to the position 57, three fluid flows 58, 59, 60 are possible in the control valve which are designated herein as fourth fluid flow 58, fifth fluid flow 59 and sixth fluid flow 60. In particular the fourth fluid flow 58 runs in FIG. 7 from the supply connection P to the first operating connection A, the fifth fluid flow 59 runs from the second operating connection B to the first operating connection A and the sixth fluid flow 60 runs from the second operating connection B to the tank drain connection T arranged at the head side 3. Subsequently exact paths of the fluid flows 58, 59, 60 are described.

The fourth fluid flow 58 runs from the supply connection P initially to the control chamber 46 like the first fluid flow 53 of FIG. 2. However, the fourth fluid flow 58 runs from the control chamber 46 through the central pass through openings 30 to the first operating connection A.

The fifth fluid flow 59 runs from the second operating connection B through the second operating pass through openings 31 and through openings 61 of the check valve flow cup 19 and from there through the second check valve 21 into the control chamber 46. From the control chamber 46 the fifth fluid flow 59 runs together with the fourth fluid flow 58 through the central pass through openings 30 to the first operating connection A.

The sixth fluid flow 60 is a simple drain flow and runs only from the second operating connection B and through the openings 31, 61 out of the control piston 18 to the tank drain connection T at the head side 3.

In the illustrated third position of the control piston device 17 the second operating connection B is closed by the second check valve 21 for a fluid that is fed by the control chamber 46. However, an exit of fluid from the second operating connection B to the control chamber 46 and the first operating connection A is possible due to a check function of the second check valve 21.

Figure 11:
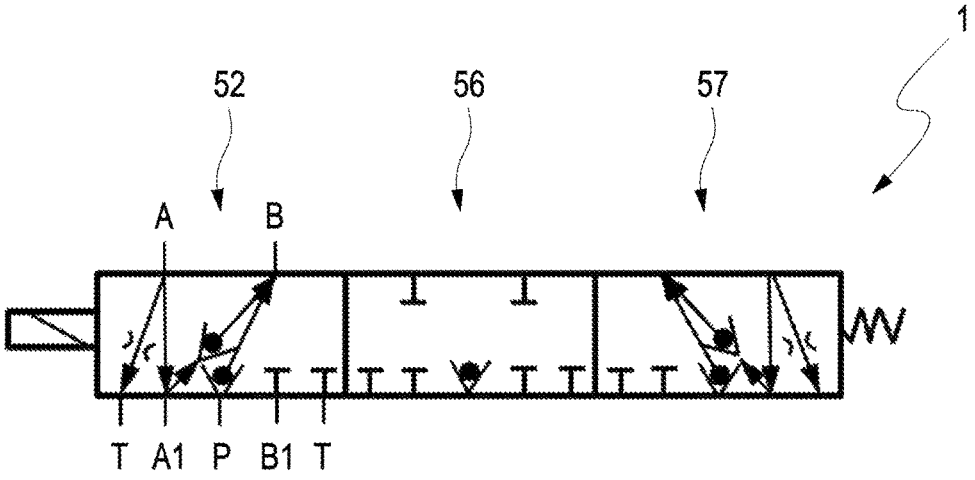
FIG. 11 illustrates a symbol view of the control valve according to FIG. 1.

FIG. 11 illustrates a symbol view of the control valve 1 and the three control positions 52, 56, 57. The control valve 1 can be set in any position between 52 and 57. The various valve positions control the flow by changing the amount the holes are uncovered. Modifying the flow controls the speed of the relative position of the camshaft to the crankshaft as desired.

Figure 12:
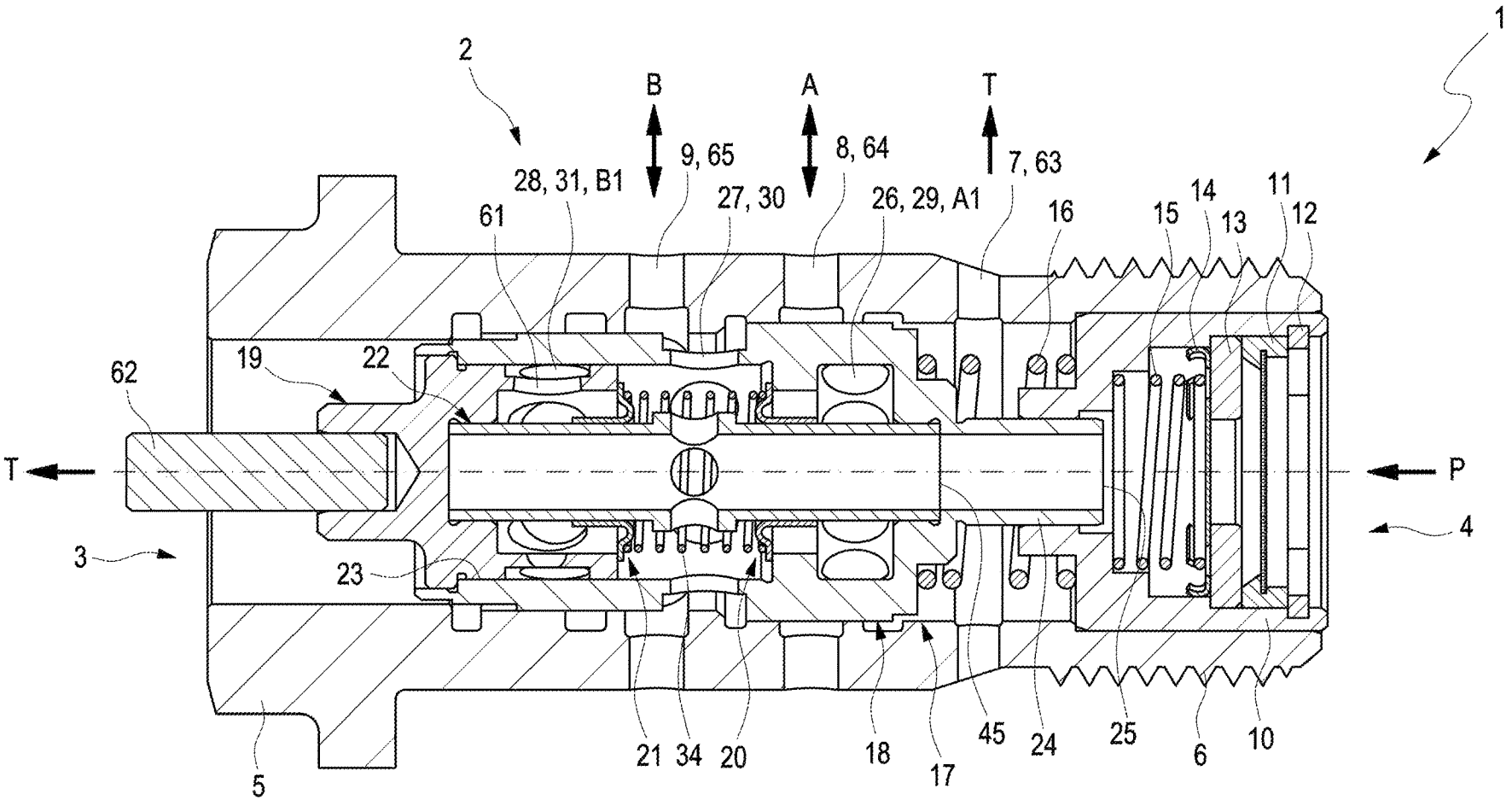
FIG. 12 a longitudinal sectional view of a second embodiment of a control valve according to the invention.

FIG. 12 illustrates a second embodiment of a control valve 1 with a cylindrical housing 2 that is configured herein as a central bolt. It only differs from the first embodiment in the design of the check valve cup 19, in which an additional valve stem or bolt 62 is fixed. Furthermore the calibration cap 10 does not protrude from the opening at the insertion side 4.

What is claimed is:

1. A control valve for a cam phaser of an internal combustion engine, the control valve comprising:

a cylindrical housing, including a first operating connection, a second operating connection, a supply connection, and a tank drain connection configured to drain a hydraulic fluid;

a control piston device, including a control piston, a supply tube, a first check valve and a second check valve enabling cam torque recirculation, wherein the control piston device is arranged in the cylindrical housing and axially movable by an actuator, wherein the first check valve is configured with a first disc portion and a second disc portion and the second check valve is configured with a third disc portion and a fourth disc portion and the first check valve and the second check valve are arranged offset from each other by a compression coil spring so that a control chamber is formed between the first disc portion and the third disc portion, wherein the second disc portion and the fourth disc portion are arranged axially movable on the supply tube, wherein the supply tube is configured with stop elements that limit an axial movement of the first check valve and the second check valve in a direction towards the control chamber, wherein the supply tube is configured so that the second disc portion and the fourth disc portion are slidable onto the supply tube in an axial direction, wherein the compression coil spring is arranged between the first disc portion and the third disc portion and ends of the compression coil spring are guided by axial disc projections of the first disc portion and the third disc portion, and wherein the axial disc projections protrude into an inside of the compression coil spring and are configured to limit a radial movement of the compression coil spring by contacting the inside of the compression coil spring.

2. The control valve according to claim 1, wherein the first check valve and the second check valve are made from a synthetic material or from aluminum.

3. The control valve according to claim 1, wherein the stop elements are configured as larger diameter portions of the supply tube.

4. The control valve according to claim 1, wherein the first disc portion and the third disc portion are applied with respective outer edges in a sealing manner to a reduced diameter of the control piston and to a check valve flow cup, and wherein the check valve flow cup is arranged in the control piston.

5. The control valve according to claim 1, wherein the supply tube includes at least one inlet opening to the control chamber, wherein the at least one inlet opening is arranged so that the hydraulic fluid is fed to the control chamber centrally and symmetrically between the first check valve and the second check valve.

6. The control valve according to claim 5, wherein the supply tube is configured with a hollow cylinder which includes the at least one inlet opening to the control chamber and a connection opening that connects with the supply connection.

7. The control valve according to claim 1, wherein the control piston device is movable into a first control position, a second control position and a third control position, wherein the first operating connection is closed by the first disc portion of the first check valve for the hydraulic fluid flowing from the control chamber in the first control position, wherein the hydraulic fluid flowing from the first operating connection into the control chamber and to the second operating connection is enabled by a check function of the first check valve, wherein the first operating connection and the second operating connection are closed in the second control position, and wherein the second operating connection is closed by the third disc portion of the second check valve for a fluid from the control chamber in the third control position, and wherein a flow of fluid from the second operating connection into the control chamber and to the first operating connection is enabled by a check function of the second check valve.

8. The control valve according to claim 1, wherein the first check valve and the second check valve are axially arranged in the control piston and include opposite opening directions.

9. The control valve according to claim 1, wherein the control valve is configured with a supply connection non-return valve and a flow disc, and wherein the flow disc includes a circular opening along a center axis and the non-return valve includes openings in an outer section.

* * * * *